US007017385B2

(12) United States Patent
Trueit et al.

(10) Patent No.: US 7,017,385 B2
(45) Date of Patent: Mar. 28, 2006

(54) AUTOMATED PNEUMATIC DOOR SKIN HAMMER

(76) Inventors: Gerald D. Trueit, 409 N. Pacific Coast Hwy., #271, Redondo Beach, CA (US) 90277; David Kilburn, 13642 Riata St., Garden Grove, CA (US) 92844

( * ) Notice: Subject to any disclaimer, the term of this patent is extended or adjusted under 35 U.S.C. 154(b) by 0 days.

(21) Appl. No.: 10/500,199

(22) PCT Filed: Dec. 23, 2002

(86) PCT No.: PCT/US02/41605

§ 371 (c)(1),
(2), (4) Date: Jun. 28, 2004

(87) PCT Pub. No.: WO03/101640

PCT Pub. Date: Dec. 11, 2003

(65) Prior Publication Data

US 2005/0016250 A1 Jan. 27, 2005

Related U.S. Application Data

(60) Provisional application No. 60/345,364, filed on Jan. 2, 2002, provisional application No. 60/430,110, filed on Dec. 2, 2002.

(51) Int. Cl.
*B21D 5/08* (2006.01)
*B21P 31/06* (2006.01)

(52) U.S. Cl. ..... 72/479; 72/456; 29/243.58

(58) Field of Classification Search ..... 72/386, 72/456, 457, 479, 480; 29/243.57, 243.58, 29/275

See application file for complete search history.

(56) References Cited

U.S. PATENT DOCUMENTS

| | | | | | |
|---|---|---|---|---|---|
| 2,436,278 | A * | 2/1948 | Willett | ..... | 29/243.58 |
| 3,188,729 | A * | 6/1965 | Pogue, Jr., et al. | ..... | 29/243.58 |
| 3,421,356 | A * | 1/1969 | Buske | ..... | 72/479 |
| 3,426,573 | A * | 2/1969 | Wilson, Jr. | ..... | 72/434 |
| 3,602,032 | A * | 8/1971 | Skintzis | ..... | 29/243.58 |
| 4,677,840 | A * | 7/1987 | Kellogg et al. | ..... | 72/465 |
| 5,095,735 | A * | 3/1992 | Schneider, Jr. | ..... | 72/479 |
| 6,470,729 | B1 * | 10/2002 | Hughes et al. | ..... | 72/479 |

* cited by examiner

*Primary Examiner*—David Jones
(74) *Attorney, Agent, or Firm*—Henry M. Bissell

(57) ABSTRACT

Pneumatic door skins tool that uses air power to bend an automobile door skin edge with little effort. The tool is fully adjustable and has manual controls to allow a person to complete the task in a minimum amount of time with a minimal amount of effort.

14 Claims, 2 Drawing Sheets

AUTOMATED PNEUMATIC DOOR SKIN HAMMER

This application claims the benefit of U.S. Provisional Application No. 60/430,110, filed Dec. 2, 20002 and U.S. Provisional Application No. 60/345,364, filed Jan. 2, 2002. This application is a 371 of PCT application Ser. No. PCT/US02/41605, filed Dec. 23, 2002.

FIELD OF THE INVENTION

This invention relates to the collision industry, and more particularly relates to the method by which damaged automobile doors are repaired.

BACKGROUND OF THE INVENTION

Presently, if an automobile has had damage to one of the doors, an approved method of repair is to put an original equipment manufactured sheet metal door shell on, in replacement of the damaged one. This involves removing the damaged door shell and replacing it with a new one. The shells are referred to as skins, in the collision industry. The current method of installing the new replacement is using a hand "dolly" (piece of metal that looks like a heel of a shoe) and a hand held hammer. When attaching a door skin initially, the edge of the metal approximately ⅜"–½" to be attached, is already bent 90 degrees or perpendicular from the skin. The metal skin is affixed to the frame of the door by crimping the edge of the metal of the skin onto the door frame by placing the dolly on front side of the door frame and hammering the edge of the skin an additional 90 degrees thereby crimping the metal flat on the back side so that it is affixed to the door frame. This is a time consuming operation and often causes damage to the door skin due to too much hammering on the metal with too much force.

Therefore, the object of the invention is to use air power to power the invention that will crimp the edge of the metal of the skin to the doorframe.

Another object of the present invention is to crimp the edge of the metal skin using less time than current methods.

Another object of the present invention is to create less damage to the door skin, by controlling the force used while crimping the edge of the metal skin.

BRIEF DESCRIPTION OF THE INVENTION

The purpose of the present invention is to provide a tool that will replace the current manual method of affixing door skins, with an automated method of affixing door skins. A tool that will create less damage to the door skin by using air to control the force applied to the door skin with the tool.

This is achieved, by connecting the invention to a pneumatic air hammer, that will provide the power to a metal hammer that in turn, hammers the edge of the metal door skin with a controlled force, while protecting the front side of the door skin with molded rubber block.

BRIEF DESCRIPTION OF THE DRAWINGS

A better understanding of the present invention may be realized from a consideration of the following detailed description, taken in conjunction with the accompanying drawings, in which.

Figure 1:
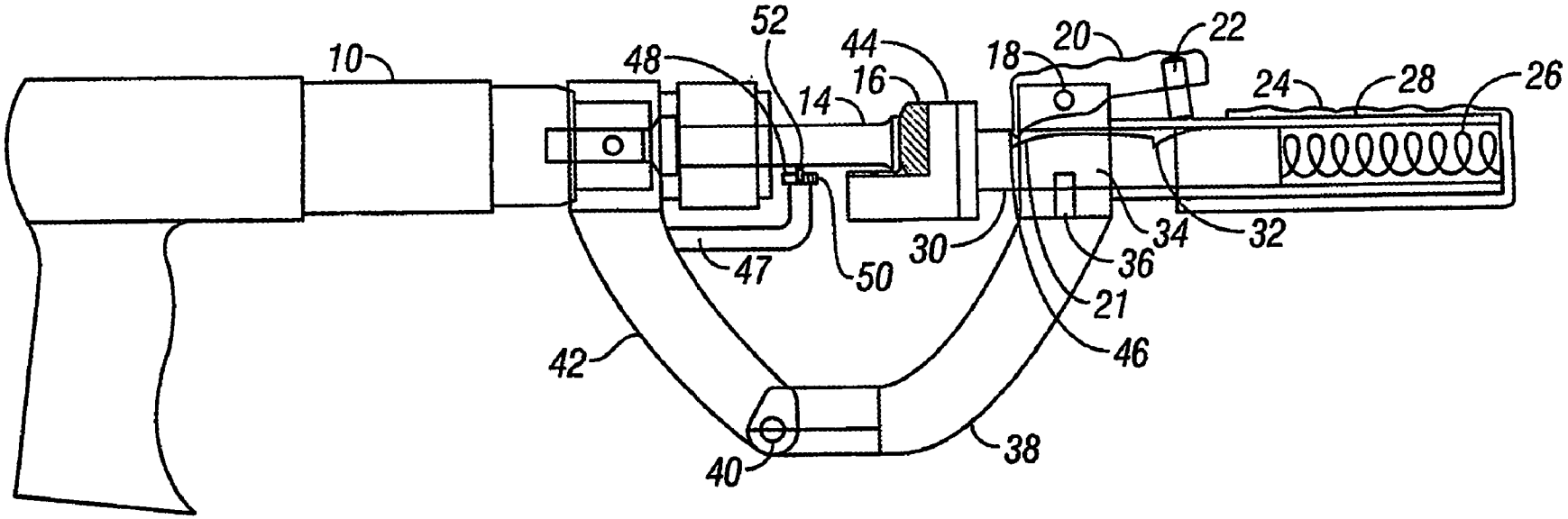
FIG. 1 is a drawing of the invention and its parts when connected to an air hammer.

The drawing figures are shown oriented 90° from the operating position of the depicted apparatus; i.e., left is up and right is down or lower.

DESCRIPTION OF THE PREFERRED EMBODIMENT

Figure 2:
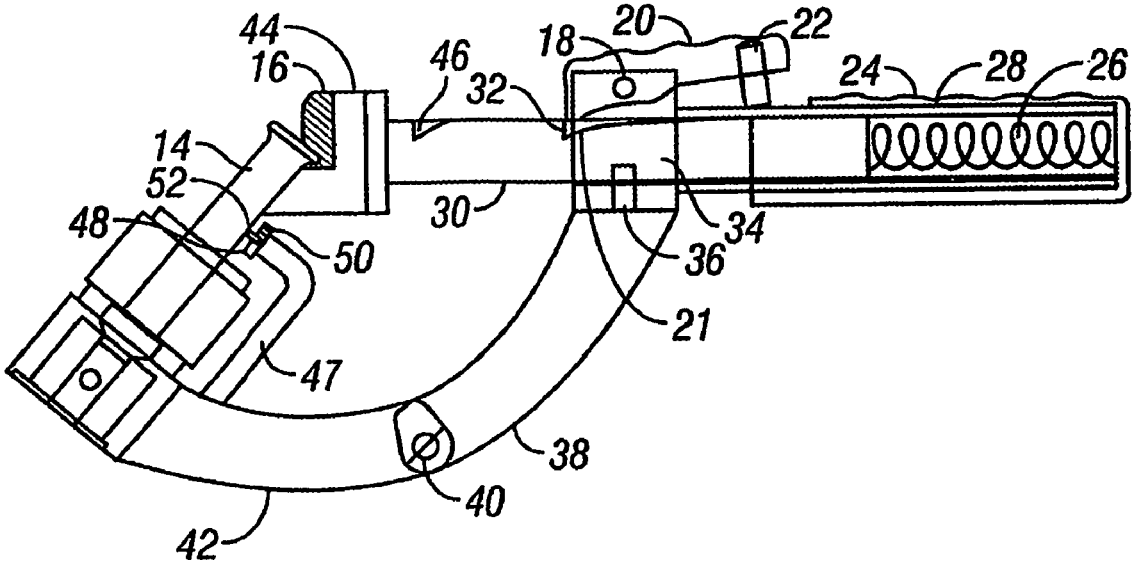
FIG. 2 is a drawing of the invention and its parts during the first step of operation.
Figure 3:
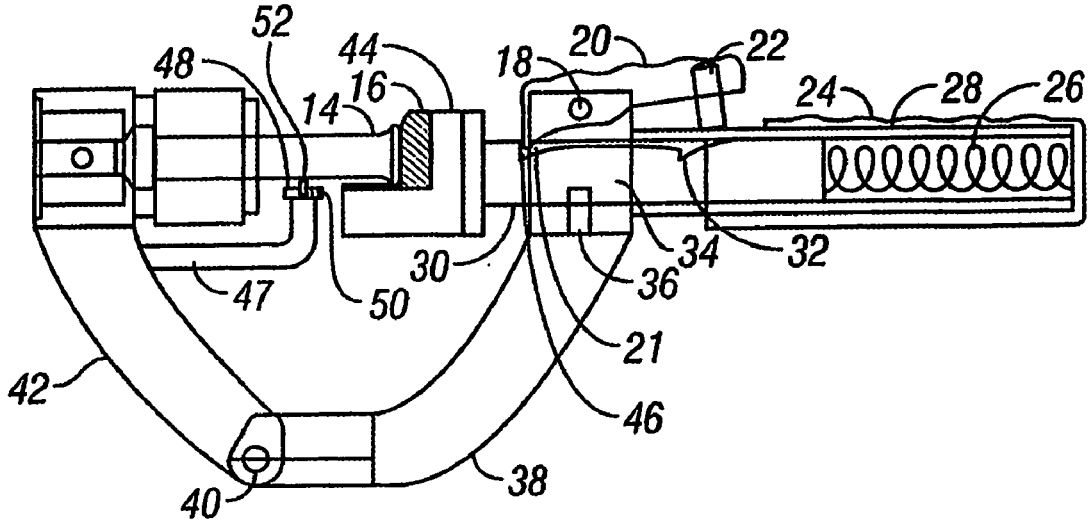
FIG. 3 is a drawing of the invention and its parts during the final step of operation.

An automated pneumatic door skin hammer is illustrated in FIGS. 1–3 which will substantially speed up the process by which door skins are presently attached to door frames.

Referring to FIG. 1 the system uses a generic air hammer 10 to provide force by means of a down stroke to the striking hammer 14. The striking hammer 14 has a pin 52 mounted thereon. The tubular sleeve 48 has an opening slot on one side allowing the pin 52 to ride in the sleeve 48 unobstructed. The pin 52 keeps the hammer 14 from turning while under power from the air hammer 10. The spring 50 propels the pin 52 upwards and thereby the hammer 14 upwards after the air hammer 10 has completed its down stroke. The tubular sleeve is mounted on the end of sleeve arm 47. Sleeve arm 47 is connected to upper connecting arm 42 by an attachment member (not shown).

The invention comprises an upper connecting arm 42 that has an attaching means to the air hammer 10 which in turn provides the force to drive the striking hammer 14, to bend the metal door skin edge over the door frame, while using the rubber block 16 as a cushioning material to protect the front, or outer, face of the door skin. The rubber block 16 is attached to a metal platform 44, which in turn is attached to a metal shaft 30. The shaft 30 is variably held in place by means of upper locking, or latching, groove or recess 46, and lower, or latching, groove or recess 32. The shaft 30, rides in the body 28, and is propelled up by a spring 26. The shaft 30 does not turn while in the body 28, because of a channel in shaft 30, and a channel guide 36 attached to the lower body head 34. The locking handle 20 has a projection 21 for engaging the selected latching recess 46 or 32 which is most effective in the steps needed to bend the edge of the metal door skin over.

When operational, See FIG. 2, the first step is to release the locking handle 20, from its upper locking point 46, allowing spring 26, to propel shaft 30, upwards until shaft 30 locks into place determined by lower locking point 32.

The locking handle 20, has an attachment means to lower body head 34. It has a release and locking movement means using a swivel pin 18, and a spring 22. While locked into lower locking point 32, one has to pivot out the upper connecting arm 42 approximately 45 degrees from the pivot point 40. This allows the striking hammer 14, while under power, to hit the door skin edge at a predetermined angle thereby bending the metal edge of the door skin over to that predetermined angle. The tool is positioned so that the end of the striking hammer 14 and the block 16 straddle the bent edge of the door skin (not shown).

The invention comprises an upper connecting arm 42 that has an attaching means to the air hammer 10 which in turn provides the force to drive the striking hammer 14, to bend the metal door skin edge over the door frame, while using the rubber block 16 as a cushioning material to protect the front face of the door skin. The rubber block 16 has an attaching means to a metal platform 44, with an attaching means to a metal shaft 30. The shaft, 30 is held in place by means of upper locking point 46, and lower locking point 32.

The shaft 30, rides in the body 28, and is propelled up by a spring 26, The shaft does not turn while in the body 28, The upper connecting arm 42 is connected to the lower connecting arm 38 by means of a pivot point 40. The lower connecting arm 38 is attached to the lower body head 34, as by welding. The lower body head 34 is hollow and is attached to the body 28, which comprises a metal tube to enclose spring 26. The tube is encased within a rubber hand grip 24.

Once the initial bending operation is completed, See FIG. 3, the shaft 30 is forced downward and positioned into upper locking point 46. The upper connecting arm 42 is repositioned so as to allow the striking hammer 14 to strike the edge of the metal door skin flat against the rubber block 16, thereby completing the step of crimping the edge of the door skin over the edge of the door.

Although there have been described herein above various specific arrangements of a pneumatic door skin hammer in accordance with the invention for the purposes of illustrating the manner in which the invention may be used to advantage, it will be appreciated that the invention is not limited thereto. Accordingly, any and all modifications which may occur to 6 those skilled in the art should be considered within the scope of the invention as defined herein.

What is claimed is:

1. Door skin hammer apparatus adapted for activation by a conventional pneumatic door hammer comprising:

a frame supporting an axially slidable striking hammer having a head adapted to mate with an anvil equipped with a resilient bed member;

said anvil being mounted for axial movement within a hollow support member between spatially separated latching members;

means for selectively mounting the striking hammer in one of two operative positions as crimping of a vehicle door skin edge progresses from an angle of approximately 90° to the generally planar shape of the door skin to a finished fully-folded shape encasing the door edge;

said anvil and said striking head being mountable on opposite sides of the vehicle door skin edge so as to fold said door skin edge about said door edge;

the first position being established at a selected angle between the approximately ninety-degree initial configuration of the door skin edge and 90° to the plane of the door skin; and the second position being established at an angle essentially perpendicular to the plane of the door for achieving complete crimping of the door skin to the door frame.

2. The apparatus of claim 1 wherein said selected angle for said first position is essentially 45°.

3. The apparatus of claim 1 wherein said frame comprises an upper body head for coupling to said air hammer and a hollow lower body head coupled to the upper body head by a pair of mutually adjustable arms mounted in a configuration to maintain said anvil in alignment with said striking hammer.

4. Door skin hammer apparatus adapted for activation by a conventional pneumatic door hammer comprising:

a frame supporting an axially slidable striking hammer having a head adapted to mate with an anvil equipped with a resilient bed member;

means for selectively mounting the striking hammer in one of two operative positions as crimping of a vehicle door skin edge progresses from an angle of approximately 90° to the generally planar share of the door skin to a finished fully-folded shape encasing the door edge;

said anvil and said striking head being mountable on opposite sides of the vehicle door skin edge so as to fold said door skin edge about said door edge;

the first position being established at a selected angle between the approximately ninety-degree initial configuration of the door skin edge and 90° to the plane of the door skin; and the second position being established at an angle essentially perpendicular to the plane of the door for achieving complete crimping of the door skin to the door frame;

wherein said frame comprises an upper body head for coupling to said air hammer and a hollow lower body head coupled to the upper body head by a pair of mutually adjustable arms mounted in a configuration to maintain said anvil in alignment with said striking hammer; and wherein said anvil is fixed on the end of a shaft which is slidable within said hollow lower body head between positions defined by a pair of latching recesses on said shaft.

5. The apparatus of claim 4 further comprising a hollow handle attached to said lower body head, said hollow handle containing biasing means for urging said shaft and anvil in the direction of said striking hammer.

6. The apparatus of claim 5 wherein said shaft is provided with at least two spaced-apart latching recesses for use in latching the anvil in a retracted position or in an extended position relative to the handle.

7. The apparatus of claim 6 further including a pivoted lever having an outer end for engaging one of the said recesses and a spring for biasing said lever into engagement with said recesses.

8. The apparatus of claim 7 further comprising a hand grip of resilient material encasing said handle.

9. The apparatus of claim 8 wherein said upper and lower arm extensions are coupled together in a lockable joint to fix the upper body head and lower body head in a selected position for the striking hammer.

10. The apparatus of claim 9 wherein said lockable joint comprises an adjustable mounting mechanism.

11. The apparatus of claim 10 wherein said adjustable mounting mechanism includes a slot in an end of one of said arms and a threaded fastener coupled through said slot to an adjacent end of the other one of said arms.

12. The apparatus of claim 11 further includes means adjacent to the striking hammer for maintaining the position of the hammer against rotation.

13. The apparatus of claim 12 wherein said means incorporates a pin extending laterally from the striking hammer and a tubular sleeve for receiving said pin, and further including a spring mounted in said tubular sleeve and bearing against said pin to keep the striking hammer in contact with the pneumatic hammer during a return stroke thereof.

14. The apparatus of claim 5 including means for preventing rotation of the shaft and anvil during operation comprising a channel in said shaft which is engaged by a channel guide attached to the lower body head.

* * * * *